US011124950B2

(12) United States Patent
Howell et al.

(10) Patent No.: US 11,124,950 B2
(45) Date of Patent: Sep. 21, 2021

(54) EXCAVATOR CONTROL ARCHITECTURE FOR GENERATING SENSOR LOCATION AND OFFSET ANGLE

(71) Applicant: Caterpillar Trimble Control Technologies LLC, Dayton, OH (US)

(72) Inventors: Mark Nicholas Howell, Christchurch (NZ); Samuel Joseph Frei, Christchurch (NZ)

(73) Assignee: CATERPILLAR TRIMBLE CONTROL TECHNOLOGIES LLC, Dayton, OH (US)

( * ) Notice: Subject to any disclaimer, the term of this patent is extended or adjusted under 35 U.S.C. 154(b) by 310 days.

(21) Appl. No.: 16/410,188

(22) Filed: May 13, 2019

(65) Prior Publication Data

US 2019/0277009 A1 Sep. 12, 2019

Related U.S. Application Data

(63) Continuation of application No. 15/385,119, filed on Dec. 20, 2016, now Pat. No. 10,329,741.

(51) Int. Cl.
*E02F 9/26* (2006.01)
*E02F 3/32* (2006.01)
(Continued)

(52) U.S. Cl.
CPC ..... *E02F 9/265* (2013.01); *E02F 3/32* (2013.01); *E02F 3/437* (2013.01); *E02F 9/264* (2013.01); *E02F 3/3681* (2013.01)

(58) Field of Classification Search
None
See application file for complete search history.

(56) References Cited

U.S. PATENT DOCUMENTS 6,691,437 B1 2/2004 Yost et al.
7,293,376 B2 11/2007 Glover
(Continued)

FOREIGN PATENT DOCUMENTS

CN 108867727 A * 11/2018
RU 2032029 C1 3/1995
RU 2572434 C1 1/2016

OTHER PUBLICATIONS

Marins, An Extended Kalman Filter for Quaternion-Based Orientation Estimation Using MARG Sensors, Proceedings of the 2001 IEEE/RJS, International Conference on Intelligent Robots and Systems, Nov. 2001 (Year: 2001).*
(Continued)

*Primary Examiner* — David P. Merlino
(74) *Attorney, Agent, or Firm* — Dinsmore & Shohl, LLP

(57) ABSTRACT

A machine is disclosed including a sensor on a limb, an implement, an architecture, and a linkage assembly (LA) including a boom and a stick. The architecture comprises one or more LA actuators and a controller that generates a sensor location $r$ and offset angle $\phi$ and is programmed to: pivot the limb (either the boom or stick) about a pivot point and generate a set of sensor signals. The controller is programmed to repeatedly execute an iterative process n times until exceeding a threshold, which process comprises determining a sensor location estimate $r_n$ (a distance between the sensor and the pivot point) and an offset angle estimate $\phi_n$ defined relative to a limb axis. A utilized optimization model includes the set of sensor signals and error terms.

20 Claims, 4 Drawing Sheets

(51) Int. Cl.
*E02F 3/43* (2006.01)
*E02F 3/36* (2006.01)

(56) References Cited

U.S. PATENT DOCUMENTS

| | | | | |
|---|---|---|---|---|
| 2003/0226290 | A1 | 12/2003 | Savard et al. | |
| 2015/0330060 | A1 | 11/2015 | Seki et al. | |
| 2016/0109270 | A1 | 4/2016 | Zabegaev | |
| 2019/0234047 | A1* | 8/2019 | Nygren | E02F 9/2004 |

OTHER PUBLICATIONS

Muth, Nicholas, et al., "The Development of a Geo-Referened System for Machine Controlled Construction Equipment", SensorDevices 2013—The Fourth International Conference on Sensor Device Technologies and Applications.

"Müller. Steffen, et al", "Dynamic, Continuous and Center of Gravity Independent Weighing with a Loader", Vom Fachbereich Maschinenbau and Verfahrenstechnik der Technischen Universitat Kaiserslautern zur Verleihung des akademischen Grades.

Gustafsson, Johan, "Orientation Estimation of a Rigid Multi Body System Using Accelerometers, Gyroscopes and the Geometry"; Department of Signal and Systems, Chalmers University of Technology, Masters Thesis EX035/2014.

International Search Report and Written Opinion dated Apr. 26, 2018 pertaining to International Application No. PCT/US2017/065809.

* cited by examiner

EXCAVATOR CONTROL ARCHITECTURE FOR GENERATING SENSOR LOCATION AND OFFSET ANGLE

CROSS-REFERENCE TO RELATED APPLICATIONS

The present application is a continuation of U.S. patent application Ser. No. 15/385,119, entitled "Excavator Control Architecture for Generating Sensor Location and Offset Angle," and filed on Dec. 20, 2016, the entirety of which is incorporated by reference herein.

BACKGROUND

The present disclosure relates to excavators which, for the purposes of defining and describing the scope of the present application, comprise an excavator boom and an excavator stick subject to swing and curl, and an excavating implement that is subject to swing and curl control with the aid of the excavator boom and excavator stick, or other similar components for executing swing and curl movement. For example, and not by way of limitation, many types of excavators comprise a hydraulically or pneumatically or electrically controlled excavating implement that can be manipulated by controlling the swing and curl functions of an excavating linkage assembly of the excavator. Excavator technology is, for example, well represented by the disclosures of U.S. Pat. No. 8,689,471, which is assigned to Caterpillar Trimble Control Technologies LLC and discloses methodology for sensor-based automatic control of an excavator, US 2008/0047170, which is assigned to Caterpillar Trimble Control Technologies LLC and discloses an excavator 3D laser system and radio positioning guidance system configured to guide a cutting edge of an excavator bucket with high vertical accuracy, and US 2008/0000111, which is assigned to Caterpillar Trimble Control Technologies LLC and discloses methodology for an excavator control system to determine an orientation of an excavator sitting on a sloped site, for example.

BRIEF SUMMARY

According to the subject matter of the present disclosure, an excavator an excavating linkage assembly, a dynamic sensor, an excavating implement, and control architecture. The excavating linkage assembly comprises an excavator boom, an excavator stick, a boom coupling, a stick coupling, and an implement coupling. The dynamic sensor is positioned on a limb, wherein the limb is one of the excavator boom and the excavator stick. The control architecture comprises one or more linkage assembly actuators, and an architecture controller programmed to operate as a partial function of a sensor location $\mathbf{r}$ and an offset angle $\phi$ of the dynamic sensor. The architecture controller is programmed to execute machine readable instructions to pivot the limb on which the dynamic sensor is positioned about a pivot point, and generate a set of dynamic signals ($A_X$, $A_Y$, $\dot{\theta}_M$, $\hat{\dot{\theta}}$, $\hat{\theta}$) at least partially derived from the dynamic sensor, the set of dynamic signals comprising an x-axis acceleration value $A_X$, a y-axis acceleration value $A_Y$, a measured angular rate relative to gravity $\dot{\theta}_M$, an estimated angular rate $\hat{\dot{\theta}}$, and an estimated angular position $\hat{\theta}$. The architecture controller is programmed to execute machine readable instructions to execute an iterative process comprising determining a sensor location estimate $\mathbf{r}_n$ and an offset angle estimate $\phi_n$, the sensor location estimate $\mathbf{r}_n$ defined as a distance between the dynamic sensor and the pivot point. The offset angle estimate $\phi_n$ of the dynamic sensor is defined relative to a limb axis, and the determination comprises the use of an optimization model comprising the set of dynamic signals ($A_X$, $A_Y$, $\dot{\theta}_M$, $\hat{\dot{\theta}}$, $\hat{\theta}$). The iterative process is repeated n times to generate a set of sensor location estimates ($\mathbf{r}_1$, $\mathbf{r}_2$, . . . , $\mathbf{r}_n$) and a set of angle offset estimates ($\phi_1$, $\phi_2$, . . . , $\phi_n$) until n exceeds an iteration threshold t. The sensor location $\mathbf{r}$ and the offset angle $\phi$ is generated based on the set of sensor location estimates ($\mathbf{r}_1$, $r_2$, . . . , $\mathbf{r}_n$), the set of angle offset estimates ($\phi_1$, $\phi_2$, . . . , $\phi_n$).

In accordance with one embodiment of the present disclosure, an earthmoving machine comprises a dynamic sensor, an earthmoving implement, and control architecture. The dynamic sensor is positioned on a limb of the earthmoving machine. The control architecture comprises one or more linkage assembly actuators, and an architecture controller programmed to operate as a partial function of a sensor location $\mathbf{r}$ and an offset angle $\phi$ of the dynamic sensor. The architecture controller is programmed to execute machine readable instructions to pivot the limb on which the dynamic sensor is positioned about a pivot point, and generate a set of dynamic signals ($A_X$, $A_Y$, $\dot{\theta}_M$, $\hat{\dot{\theta}}$, $\hat{\theta}$) at least partially derived from the dynamic sensor, the set of dynamic signals comprising an x-axis acceleration value $A_X$, a y-axis acceleration value $A_Y$, a measured angular rate $\dot{\theta}_M$, estimated angular rate $\hat{\dot{\theta}}$, and an estimated angular position $\hat{\theta}$. The architecture controller is further programmed to execute machine readable instructions to execute an iterative process comprising determining a sensor location estimate $\mathbf{r}_n$ and an offset angle estimate $\phi_n$, the sensor location estimate $\mathbf{r}_n$ defined as a distance between the dynamic sensor and the pivot point. The offset angle estimate $\phi_n$ of the dynamic sensor is defined relative to a limb axis, and the determination comprises the use of an optimization model comprising the set of dynamic signals ($A_X$, $A_Y$, $\dot{\theta}_M$, $\hat{\dot{\theta}}$, $\hat{\theta}$). The iterative process is repeated n times to generate a set of sensor location estimates ($\mathbf{r}_1$, $\mathbf{r}_2$, . . . , $\mathbf{r}_n$) and a set of angle offset estimates ($\phi_1$, $\phi_2$, . . . , $\phi_n$) until n exceeds an iteration threshold t. The sensor location r and the offset angle $\phi$ is generated based on the set of sensor location estimates ($\mathbf{r}_1$, $\mathbf{r}_2$, . . . , $\mathbf{r}_n$), the set of angle offset estimates ($\phi_1$, $\phi_2$, . . . , $\phi_n$).

In accordance with another embodiment of the present disclosure, a method of generating a sensor location $\mathbf{r}$ and an offset angle $\phi$ of a dynamic sensor on and with respect to a limb of an earthmoving machine comprises pivoting, via an architecture controller, the limb on which the dynamic sensor is positioned about a pivot point, and generating a set of dynamic signals ($A_X$, $A_Y$, $\dot{\theta}_M$, $\hat{\dot{\theta}}$, $\hat{\theta}$) at least partially derived from the dynamic sensor, the set of dynamic signals comprising an x-axis acceleration value $A_X$, a y-axis acceleration value $A_Y$, a measured angular rate $\dot{\theta}_M$, an estimated angular rate $\hat{\dot{\theta}}$, and an estimated angular position $\hat{\theta}$. The method further comprises executing an iterative process comprising determining a sensor location estimate $\mathbf{r}_n$ and an offset angle estimate $\phi_n$. The sensor location estimate $\mathbf{r}_n$ is defined as a distance between the dynamic sensor and the pivot point. The offset angle estimate $\phi_n$ of the dynamic sensor is defined relative to a limb axis, and the determination comprises the use of an optimization model comprising the set of dynamic signals ($A_X$, $A_Y$, $\dot{\theta}_M$, $\hat{\dot{\theta}}$, $\hat{\theta}$). The iterative process is repeated n times to generate a set of sensor location estimates ($r_1, r_2, \ldots, r_n$) and a set of angle offset estimates ($\phi_1, \phi_2, \ldots \phi_n$) until n exceeds an iteration threshold t. The method further comprises, via the architecture controller, generating the sensor location $r$ and the offset angle $\phi$ based on the set of sensor location estimates ($r_1, r_2, \ldots, r_n$) and the set of angle offset estimates ($\phi_1, \phi_2, \ldots, \phi_n$).

Although the concepts of the present disclosure are described herein with primary reference to the excavator illustrated in FIG. 1, it is contemplated that the concepts will enjoy applicability to any type of excavator, regardless of its particular mechanical configuration. For example, and not by way of limitation, the concepts may enjoy applicability to a backhoe loader including a backhoe linkage.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

The present disclosure relates to earthmoving machines and, more particularly, to earthmoving machines such as excavators including components subject to control. For example, and not by way of limitation, many types of excavators typically have a hydraulically controlled earthmoving implement that can be manipulated by a joystick or other means in an operator control station of the machine, and is also subject to partially or fully automated control. The user of the machine may control the lift, tilt, angle, and pitch of the implement. In addition, one or more of these variables may also be subject to partially or fully automated control based on information sensed or received by an adaptive environmental sensor of the machine. In the embodiments described herein, an excavator calibration utilizes a control architecture to determine a location of a dynamic sensor positioned on an excavator limb and a sensor offset of the sensor disposed on the limb, as described in greater detail further below. Such determined values may be utilized by an excavator control to operate the excavator.

Figure 1:
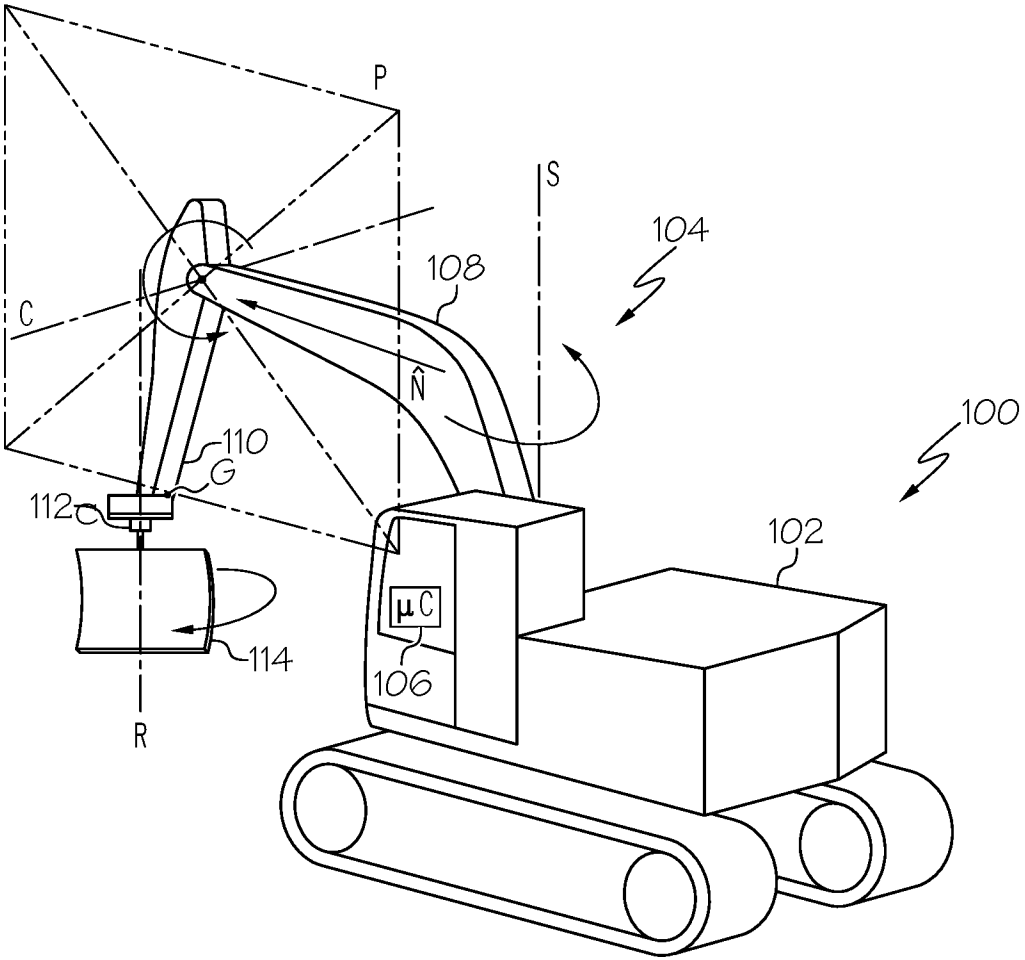
FIG. 1 illustrates an excavator incorporating aspects of the present disclosure.
Figure 2:
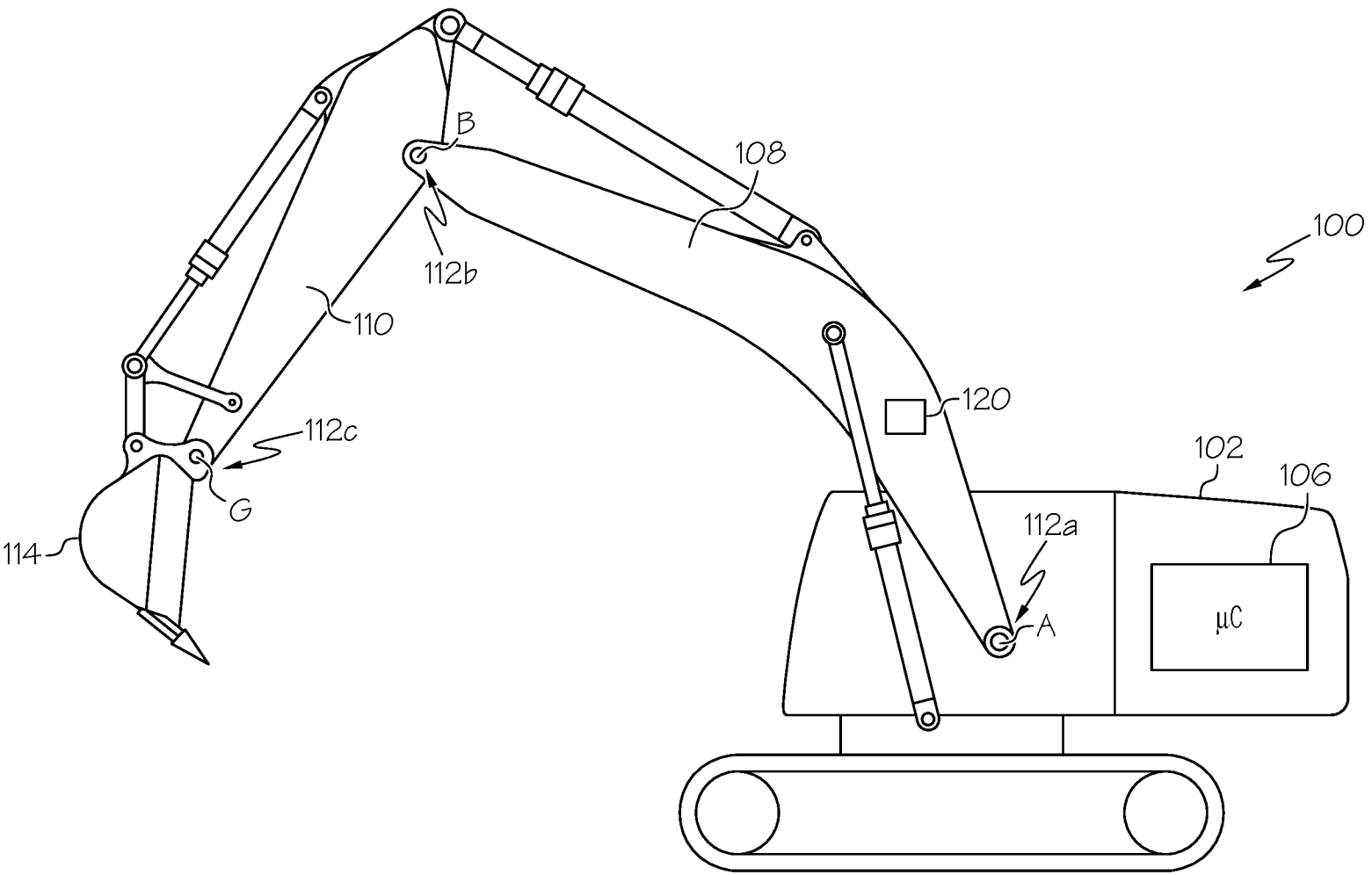
FIG. 2 is a side view of an excavator incorporating aspects of the present disclosure.

Referring initially to FIGS. 1-2, an excavator 100 comprising a machine chassis 102, an excavating linkage assembly 104, a dynamic sensor 120, an excavating implement 114, and control architecture 106. The excavating linkage assembly 104 comprises an excavator boom 108, an excavator stick 110, a boom coupling 112A, a stick coupling 112B, and an implement coupling 112C. The dynamic sensor 120 is positioned on a limb, wherein the limb is one of the excavator boom 108 and the excavator stick 110.

Figure 3:
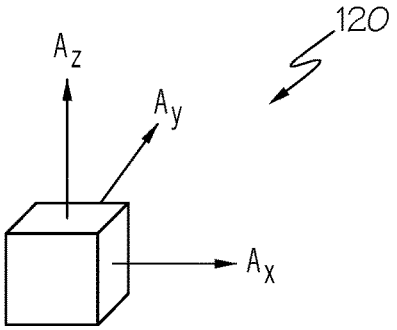
FIG. 3 is an isometric view of a dynamic sensor, which can be disposed on a linkage of the excavator of FIG. 2.
Figure 4:
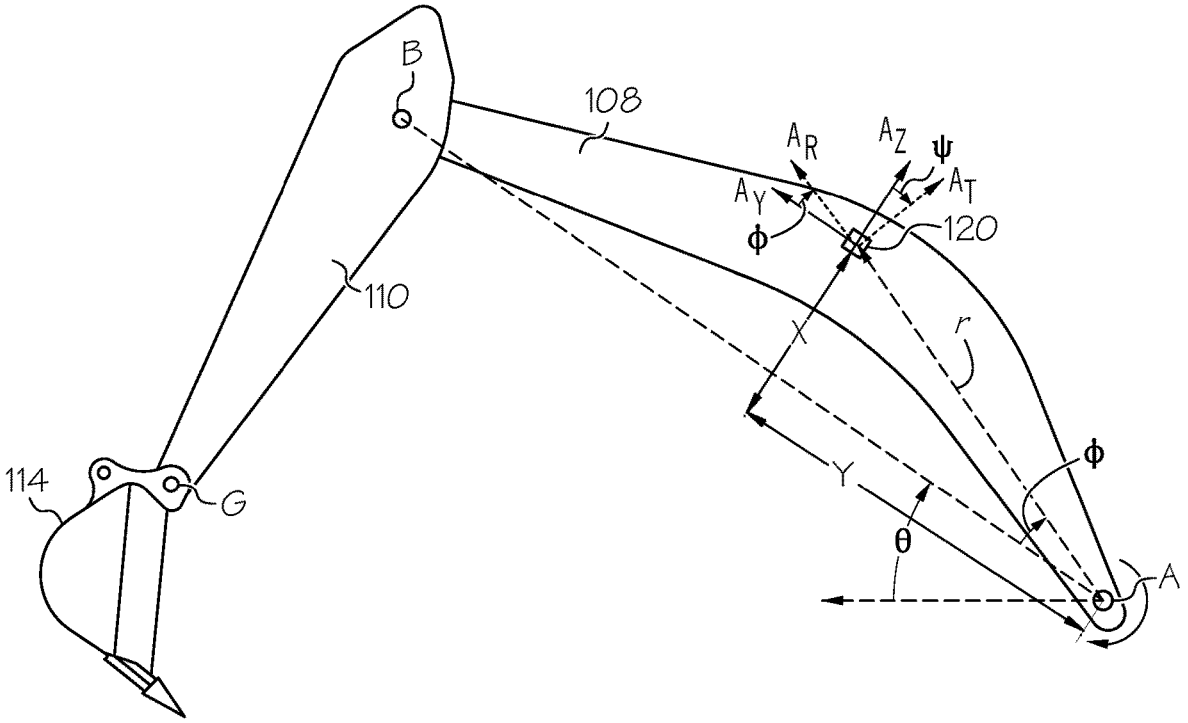
FIG. 4 is a side elevation view of a linkage assembly of the excavator of FIG. 2.

In embodiments, and referring to FIGS. 2-4, the dynamic sensor 120 comprises an inertial measurement unit (IMU), an inclinometer, an accelerometer, a gyroscope, an angular rate sensor, a rotary position sensor, a position sensing cylinder, or combinations thereof. For example, the dynamic sensor 120 may comprise an IMU comprising a 3-axis accelerometer and a 3-axis gyroscope. As shown in FIG. 3, the dynamic sensor 120 includes accelerations $A_x$, $A_y$, and $A_z$, respectively representing x-axis, y-axis-, and z-axis acceleration values.

The excavating linkage assembly 104 may be configured to define a linkage assembly heading $\hat{N}$ and to swing with, or relative to, the machine chassis 102 about a swing axis S of the excavator 100. The excavator stick 110 is configured to curl relative to the excavator boom 108. For example, the excavator stick 110 may be configured to curl relative to the excavator boom 108 about a curl axis C of the excavator 100. The excavator boom 108 and excavator stick 110 of the excavator 100 illustrated in FIG. 1 are linked by a simple mechanical coupling that permits movement of the excavator stick 110 in one degree of rotational freedom relative to the excavator boom 108. In these types of excavators, the linkage assembly heading $\hat{N}$ will correspond to the heading of the excavator boom 108. However, the present disclosure also contemplates the use of excavators equipped with offset booms where the excavator boom 108 and excavator stick 110 are linked by a multidirectional coupling that permits movement in more than one rotational degree of freedom. See, for example, the excavator illustrated in U.S. Pat. No. 7,869,923 ("Slewing Controller, Slewing Control Method, and Construction Machine"). In the case of an excavator with an offset boom, the linkage assembly heading $\hat{N}$ will correspond to the heading of the excavator stick 110. In embodiments, the excavator boom 108 comprises a variable-angle excavator boom.

Referring to FIG. 2, the excavator stick 110 is mechanically coupled to a terminal pivot point B of the excavator boom 108 via the stick coupling 112B. The machine chassis 102 is mechanically coupled to a terminal pivot point A of the excavator boom 108 via the boom coupling 112A. The excavating implement 114 is mechanically coupled to the excavator stick 110. For example, the excavating implement 114 is mechanically coupled to a terminal point G of the excavator stick 110 via the implement coupling 112C.

Referring to FIG. 1, the excavating implement 114 may be mechanically coupled to the excavator stick 110 via the implement coupling 112 and configured to rotate about a rotary axis R. In an embodiment, the rotary axis R may be defined by the implement coupling 112 joining the excavator stick 110 and the rotary excavating implement 114. In an alternative embodiment, the rotary axis R may be defined by a multidirectional, stick coupling joining the excavator boom 108 and the excavator stick 110 along the plane P such that the excavator stick 110 is configured to rotate about the rotary axis R. Rotation of the excavator stick 110 about the rotary axis R defined by the stick coupling may result in a corresponding rotation of the rotary excavating implement 114, which is coupled to the excavator stick 110, about the rotary axis R defined by the stick coupling.

The control architecture 106 comprises one or more linkage assembly actuators, and an architecture controller. The one or more linkage assembly actuators facilitate movement of the excavating linkage assembly 104. The one or more linkage assembly actuators may comprise a hydraulic cylinder actuator, a pneumatic cylinder actuator, an electrical actuator, a mechanical actuator, or combinations thereof.

The architecture controller is programmed to operate as a partial function of a sensor location $r$ and an offset angle $\phi$ of the dynamic sensor 120 and to execute machine readable instructions. The control architecture 106 may comprise a non-transitory computer-readable storage medium comprising the machine readable instructions.

Figure 5:
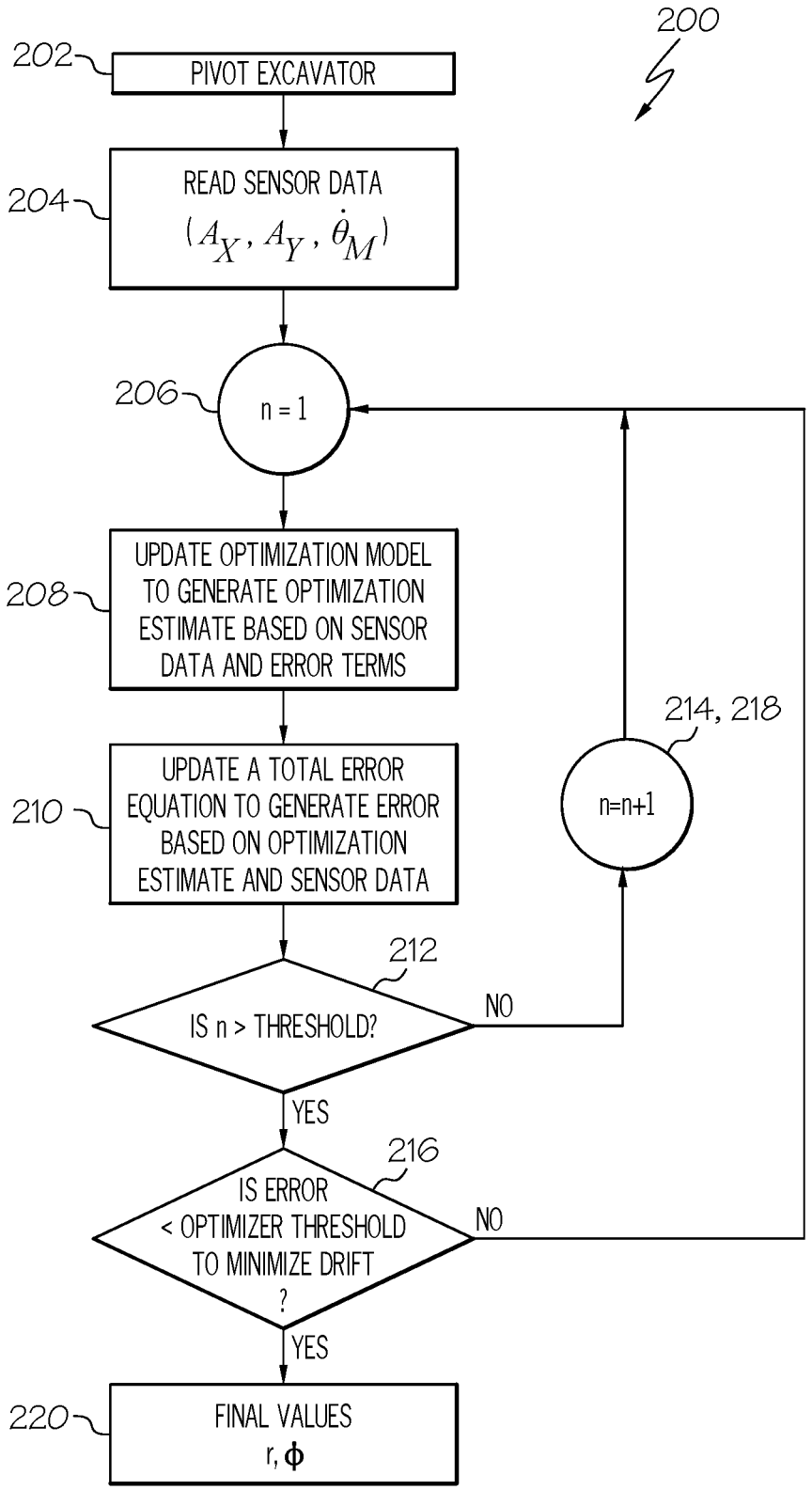
FIG. 5 is a flow chart illustrating an optimization process that may be used to determine a sensor radius estimation and a sensor offset angle with respect to a linkage axis according to aspects of the present disclosure.

As shown in control scheme 200 of FIG. 5, the machine readable instructions comprise instructions to pivot the limb on which the dynamic sensor 120 is positioned about a pivot point. In embodiments, an operator pivots the limb. The pivot point comprises the terminal pivot point A when the limb is the excavator boom 108 and the terminal pivot point B when the limb is the excavator stick 110. For example, in step 202, the excavator 100, which may include a component thereof, is pivoted.

The machine readable instructions further comprising instructions to generate a set of dynamic signals ($A_X$, $A_Y$, $\dot{\theta}_M$, $\hat{\dot{\theta}}$, $\hat{\theta}$) at least partially derived from the dynamic sensor 120. The set of dynamic signals comprises an x-axis acceleration value $A_X$, a y-axis acceleration value $A_Y$, a measured angular rate $\dot{\theta}_M$, an estimated angular rate $\hat{\dot{\theta}}$, and an estimated angular position $\hat{\theta}$.

The machine readable instructions further comprise instructions to execute an iterative process. The iterative process comprises determining a sensor location estimate $r_n$ and an offset angle estimate $\phi_n$. The sensor location estimate $r_n$ is defined as a distance between the dynamic sensor and the pivot point, and the offset angle estimate $\phi_n$ of the dynamic sensor is defined relative to a limb axis. The determination comprises the use of an optimization model comprising the set of dynamic signals ($A_X$, $A_Y$, $\dot{\theta}_M$, $\hat{\dot{\theta}}$, $\hat{\theta}$) and one or more error minimization terms. For example, in step 204, such set of dynamic signals are sensor data read by the architecture controller. The iterative process, as illustrated by at least steps 206-208 and 212-214, is repeated n times to generate a set of sensor location estimates ($r_1$, $r_2$, . . . , $r_n$) and a set of angle offset estimates ($\phi_1$, $\phi_2$, . . . , $\phi_n$) until n exceeds an iteration threshold t, and the architecture controller generates (in step 220, for example) the sensor location $r$ and the offset angle $\phi$ based on the set of sensor location estimates ($r_1$, $r_2$, . . . , $r_n$), the set of angle offset estimates ($\phi_1$, $\phi_2$, . . . , $\phi_n$), and the one or more error minimization terms.

In embodiments, the iterative process further comprises steps 210, 216, and 218 of FIG. 5, including determining a total error based on the optimization model and the set of dynamic signals ($A_X$, $A_Y$, $\dot{\theta}_M$, $\hat{\dot{\theta}}$, $\hat{\theta}$), and comparing the total error against an optimization threshold. For example, in step 210, a total error equation may be updated to generate an error based on an optimization estimate determined in step 208 and the sensor data read in step 204. If n is above a threshold in step 212 but the error is not less than an optimizer threshold to minimize drift, the iterative process returns to step 206. If, however, n is above the threshold in step 212 and the error is less than the optimizer threshold in step 216, the control scheme may continue to step 220 and generate final values for the sensor location $r$ and the offset angle $\phi$. Thus, the iterative process may be executed until the total error is less than the optimization threshold to minimize drift.

In embodiments, the dynamic signals ($A_X$, $A_Y$, $\dot{\theta}_M$, $\hat{\dot{\theta}}$, $\hat{\theta}$) are generated from a captured data set originating from the dynamic sensor 120. The captured data set comprises a first data section corresponding to a first sensor location $r_1$ and a first offset angle $\phi_1$ and a second data section corresponding to a second sensor location $r_2$ and a second offset angle $\phi_2$. In embodiments, the captured data set represents pivoting the limb on which the dynamic sensor 120 is positioned for a period of time in a range of from about 10 seconds to about 30 seconds.

Further, the iterative process executed by the architecture controller comprises a validity check where sensor readings from the first data section are compared to sensor readings from the second data section to return a validity indication. For example, the validity indication is positive when the sensor readings from the first data section and the sensor readings from the second data section are within an acceptable difference of one another. The validity indication is negative when the sensor readings from the first data section and the sensor readings from the second data section are outside the acceptable difference. Further, the architecture controller may be programmed to calibrate the dynamic sensor when the validity indication is negative. Additionally or alternatively, the architecture controller may be programmed to generate the sensor location $r$ and the offset angle $\phi$ in step 220 of FIG. 5, for example, when the validity indication is positive.

The optimization model of step 208, for example, may be a function of gravitational acceleration g, an estimation error e, a tangential acceleration $A_T$ of the dynamic sensor, a dynamic angular acceleration of the dynamic sensor over time $\hat{\ddot{\theta}}$, a dynamic angular rate of the dynamic sensor over time $\hat{\dot{\theta}}$, and an initial start velocity $\dot{\theta}_{IC}$ from the dynamic sensor and an initial start angle $\theta_{IC}$ between terminal pivot points A and B of the excavator boom 108 and the excavator stick 110 relative to horizontal. The optimization model may further comprise the following set of equations:

$$\hat{\ddot{\theta}} = \frac{g}{r}(A_T + \sin(\theta)) + K_P e + K_D \dot{e} + K_I \int e \qquad \text{(Equations 1-4)}$$

$$\hat{\theta} = \int \dot{\theta}_m + \theta_{IC},$$

$$\hat{\dot{\theta}} = \int \hat{\ddot{\theta}} + \dot{\theta}_{IC}, \text{ and}$$

$$A_T = A_x \cos(\phi) - A_y \sin(\phi)$$

where $K_P$ is a proportional term coefficient, where $K_D$ is a derivative term coefficient, and $K_I$ is an integral term coefficient, and where $$e = \dot{\theta}_m - \hat{\dot{\theta}} \qquad \text{(Equation 5)}$$

for which $\dot{\theta}_m$ is a dynamic angular rate of the dynamic sensor as measured by a gyroscope of the dynamic sensor.

Further, the optimization model may comprise the following set of equations, where $A_{R,M}$ is a measured radial acceleration of the dynamic sensor, $\widehat{A_R}$ is an expected radial acceleration based on the model, and $A_{R,M}$ is equivalent to $\widehat{A_R}$:

$$A_{R,M} = A_x \sin(\phi) + A_y \cos(\phi) \qquad \text{(Equations 6-7)}$$

$$\widehat{A_R} = \frac{r}{g}\dot{\theta}^2 - \cos(\theta)$$

In embodiments, in step 210, one or more error minimization terms comprise an error based on the following equation, which summation is from sampling the solutions from Equations 1-5:

$$\text{Error} = \sum\left(\frac{r}{g}\hat{\dot{\theta}}^2 - \cos(\hat{\theta}) - A_{R,M}\right)^2 + \sum\left(\dot{\theta}_m - \hat{\dot{\theta}}\right)^2 \quad \text{(Equation 8)}$$

To account for drift in determining the final values of step 220, the incorporation of error terms into the optimization model of step 208, as well as the potential total error calculations and optimizer threshold, are useful to minimize model error of step 210. The final values of the sensor location $r$ and the offset angle $\phi$ that result in step 220 of the control scheme 200 may be used to dynamically compensate for excavator limb movement to assist with accurate determinations of limb angle and machine position.

A signal may be "generated" by direct or indirect calculation or measurement, with or without the aid of a sensor.

For the purposes of describing and defining the present invention, it is noted that reference herein to a variable being a "function" of (or "based on") a parameter or another variable is not intended to denote that the variable is exclusively a function of or based on the listed parameter or variable. Rather, reference herein to a variable that is a "function" of or "based on" a listed parameter is intended to be open ended such that the variable may be a function of a single parameter or a plurality of parameters.

It is also noted that recitations herein of "at least one" component, element, etc., should not be used to create an inference that the alternative use of the articles "a" or "an" should be limited to a single component, element, etc.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. An excavator comprising an excavating linkage assembly, a dynamic sensor, an excavating implement, and control architecture, wherein:

the excavating linkage assembly comprises an excavator boom, an excavator stick, a boom coupling, a stick coupling, and an implement coupling;

the dynamic sensor is positioned on a limb, wherein the limb is one of the excavator boom and the excavator stick; and the control architecture comprises one or more linkage assembly actuators, and an architecture controller programmed to operate as a partial function of a sensor location $r$ and an offset angle $\phi$ of the dynamic sensor and to execute machine readable instructions to pivot the limb on which the dynamic sensor is positioned about a pivot point, generate a set of dynamic signals ($A_X$, $A_Y$, $\dot{\theta}_M$, $\hat{\dot{\theta}}$, $\hat{\theta}$) at least partially derived from the dynamic sensor, the set of dynamic signals comprising an x-axis acceleration value $A_X$, a y-axis acceleration value $A_Y$, a measured angular rate relative to gravity $\dot{\theta}_M$, an estimated angular rate $\hat{\dot{\theta}}$, and an estimated angular position $\hat{\theta}$, execute an iterative process comprising determining a sensor location estimate $r_n$ and an offset angle estimate $\phi_n$, wherein (i) the sensor location estimate $r_n$ is defined as a distance between the dynamic sensor and the pivot point, (ii) the offset angle estimate $\phi_n$ of the dynamic sensor is defined relative to a limb axis, (iii) the determination comprises the use of an optimization model comprising the set of dynamic signals ($A_X$, $A_Y$, $\dot{\theta}_M$, $\hat{\dot{\theta}}$, $\hat{\theta}$), and (iv) the iterative process is repeated n times to generate a set of sensor location estimates ($r_1$, $r_2$, . . . , $r_n$) and a set of angle offset estimates ($\phi_1$, $\phi_2$, . . . , $\phi_n$) until n exceeds an iteration threshold t, and generate the sensor location $r$ and the offset angle $\phi$ based on the set of sensor location estimates ($r_1$, $r_2$, . . . , $r_n$) and the set of angle offset estimates ($\phi_1$, $\phi_2$, . . . , $\phi_n$).

2. The excavator as claimed in claim 1, wherein the iterative process further comprises:

determining a total error based on the optimization model and the set of dynamic signals ($A_X$, $A_Y$, $\dot{\theta}_M$, $\hat{\dot{\theta}}$, $\hat{\theta}$), and comparing the total error against an optimization threshold; and executing the iterative process until the total error is less than the optimization threshold to minimize drift.

3. The excavator as claimed in claim 1, wherein the dynamic sensor comprises an inertial measurement unit (IMU), an inclinometer, an accelerometer, a gyroscope, an angular rate sensor, a rotary position sensor, a position sensing cylinder, or combinations thereof.

4. The excavator as claimed in claim 1, wherein the dynamic sensor comprises an inertial measurement unit (IMU) comprising a 3-axis accelerometer and a 3-axis gyroscope.

5. The excavator as claimed in claim 1, wherein:

the set of dynamic signals ($A_X$, $A_Y$, $\dot{\theta}_M$, $\hat{\dot{\theta}}$, $\hat{\theta}$) are generated from a captured data set originating from the dynamic sensor;

the captured data set comprises a first data section corresponding to a first sensor location $r_1$ and a first offset angle $\phi_1$ and a second data section corresponding to a second sensor location $r_2$ the iterative process executed by the architecture controller comprises a validity check where sensor readings from the first data section are compared to sensor readings from the second data section to return a validity indication.

6. The excavator as claimed in claim 5, wherein:

the validity indication is positive when the sensor readings from the first data section and the sensor readings from the second data section are within an acceptable difference of one another.

7. The excavator as claimed in claim 6, wherein the validity indication is negative when the sensor readings from the first data section and the sensor readings from the second data section are outside the acceptable difference.

8. The excavator as claimed in claim 7, wherein the architecture controller is programmed to calibrate the dynamic sensor when the validity indication is negative.

9. The excavator as claimed in claim 6, wherein the architecture controller is programmed to generate the sensor location $r$ and the offset angle $\phi$ when the validity indication is positive.

10. The excavator as claimed in claim 5, wherein the captured data set represents pivoting the limb on which the dynamic sensor is positioned for a period of time in a range of from about 10 seconds to about 30 seconds.

11. The excavator as claimed in claim 1, wherein the optimization model is a function of gravitational acceleration g, an estimation error e, a tangential acceleration $A_T$ of the dynamic sensor, a dynamic angular acceleration of the dynamic sensor over time $\hat{\ddot{\theta}}$, a dynamic angular rate of the dynamic sensor over time $\hat{\dot{\theta}}$, and an initial start angle $\theta$ between the terminal pivot points A and B of the excavator boom and the excavator stick relative to horizontal.

12. The excavator as claimed in claim 11, wherein the optimization model comprises a first equation for $\hat{\ddot{\theta}}$ comprising a first term $$\frac{g}{r}(A_T + \sin(\theta))$$

and one or more error terms, and the optimization model further comprises the following additional equations:

$$\hat{\theta} = \int \dot{\theta}_m + \theta_{IC}$$

$$\hat{\dot{\theta}} = \int \hat{\ddot{\theta}} + \dot{\theta}_{IC}$$

and $$A_T = A_x \cos(\phi) - A_y \sin(\phi)$$

where $$e = \dot{\theta}_m - \hat{\dot{\theta}},$$

for which $\dot{\theta}_m$ is a dynamic angular rate of the dynamic sensor as measured by a gyroscope of the dynamic sensor.

13. The excavator as claimed in claim 11, wherein the optimization model further comprises the following set of equations:

$$A_{R,M} = A_x \sin(\phi) + A_y \cos(\phi)$$

and $$\widehat{A_R} = \frac{r}{g}\dot{\theta}^2 - \cos(\theta)$$

where $A_{R,M}$ is a measured radial acceleration of the dynamic sensor, $\widehat{A_R}$ is an expected radial acceleration based on the optimization model, and $A_{R,M}$ is equivalent to $\widehat{A_R}$.

14. The excavator as claimed in claim 11, wherein the optimization model comprises an error based on a following equation:

$$\text{Error} = \sum\left(\frac{r}{g}\hat{\dot{\theta}}^2 - \cos(\hat{\theta}) - A_{R,M}\right)^2 + \sum\left(\dot{\theta}_m - \hat{\dot{\theta}}\right)^2.$$

15. The excavator as claimed in claim 1, wherein the control architecture comprises a non-transitory computer-readable storage medium comprising the machine readable instructions.

16. The excavator as claimed in claim 1, wherein the one or more linkage assembly actuators facilitate movement of the excavating linkage assembly.

17. The excavator as claimed in claim 16, wherein the one or more linkage assembly actuators comprise a hydraulic cylinder actuator, a pneumatic cylinder actuator, an electrical actuator, a mechanical actuator, or combinations thereof.

18. The excavator as claimed in claim 1, wherein the excavator boom comprises a variable-angle excavator boom.

19. An earthmoving machine comprising a dynamic sensor, an earthmoving implement, and control architecture, wherein:

the dynamic sensor is positioned on a limb of the earthmoving machine; and the control architecture comprises one or more linkage assembly actuators, and an architecture controller programmed to operate as a partial function of a sensor location $r$ and an offset angle $\phi$ of the dynamic sensor and to execute machine readable instructions to pivot the limb on which the dynamic sensor is positioned about a pivot point, generate a set of dynamic signals ($A_X$, $A_Y$, $\dot{\theta}_M$, $\hat{\dot{\theta}}$, $\hat{\theta}$) at least partially derived from the dynamic sensor, the set of dynamic signals comprising an x-axis acceleration value $A_X$, a y-axis acceleration value $A_Y$, a measured angular rate $\dot{\theta}_M$, an estimated angular rate $\hat{\dot{\theta}}$, and an estimated angular position $\hat{\theta}$, and execute an iterative process comprising determining a sensor location estimate $r_n$ and an offset angle estimate $\phi_n$, wherein (i) the sensor location estimate $r_n$ is defined as a distance between the dynamic sensor and the pivot point, (ii) the offset angle estimate $\phi_n$ of the dynamic sensor is defined relative to a limb axis, (iii) the determination comprises the use of an optimization model comprising the set of dynamic signals ($A_X$, $A_Y$, $\dot{\theta}_M$, $\hat{\dot{\theta}}$, $\hat{\theta}$), and (iv) the iterative process is repeated n times to generate a set of sensor location estimates ($\mathbf{r}_1, \mathbf{r}_2, \ldots, \mathbf{r}_n$) and a set of angle offset estimates ($\phi_1, \phi_2, \ldots, \phi_n$) until n exceeds an iteration threshold t, and generate the sensor location $\mathbf{r}$ and the offset angle $\phi$ based on the set of sensor location estimates ($\mathbf{r}_1, \mathbf{r}_2, \ldots, \mathbf{r}_n$) and the set of angle offset estimates ($\phi_1, \phi_2, \ldots, \phi_n$).

20. A method of generating a sensor location $\mathbf{r}$ and an offset angle $\phi$ of a dynamic sensor on and with respect to a limb of an earthmoving machine, the method comprising:

pivoting, via an architecture controller, the limb on which the dynamic sensor is positioned about a pivot point;

generating a set of dynamic signals ($A_X, A_Y, \dot{\theta}_M, \hat{\dot{\theta}}, \hat{\theta}$) at least partially derived from the dynamic sensor, the set of dynamic signals comprising an x-axis acceleration value $A_X$, a y-axis acceleration value $A_Y$, a measured angular rate $\dot{\theta}_M$, an estimated angular rate $\hat{\dot{\theta}}$, and an estimated angular position $\hat{\theta}$;

executing an iterative process comprising determining a sensor location estimate $\mathbf{r}_n$ and an offset angle estimate $\phi_n$, wherein (i) the sensor location estimate $\mathbf{r}_n$ is defined as a distance between the dynamic sensor and the pivot point, (ii) the offset angle estimate $\phi_n$ of the dynamic sensor is defined relative to a limb axis, and (iii) the determination comprises the use of an optimization model comprising the set of dynamic signals ($A_X, A_Y, \dot{\theta}_M, \hat{\dot{\theta}}, \hat{\theta}$);

repeating the iterative process n times to generate a set of sensor location estimates ($\mathbf{r}_1, \mathbf{r}_2, \ldots, r_n$) and a set of angle offset estimates ($\phi_1, \phi_2, \ldots, \phi_n$) until n exceeds an iteration threshold t; and generating, via the architecture controller, the sensor location $\mathbf{r}$ and the offset angle $\phi$ based on the set of sensor location estimates ($\mathbf{r}_1, \mathbf{r}_2, \ldots, \mathbf{r}_n$) and the set of angle offset estimates ($\phi_1, \phi_2, \ldots, \phi_n$).

* * * * *